US007131782B2

(12) United States Patent
Jung

(10) Patent No.: US 7,131,782 B2
(45) Date of Patent: Nov. 7, 2006

(54) PAPER EDGE SENSING APPARATUS AND METHOD FOR BORDERLESS PRINTING

(75) Inventor: Jong-sung Jung, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/602,631

(22) Filed: Jun. 25, 2003

(65) Prior Publication Data

US 2004/0028450 A1 Feb. 12, 2004

(30) Foreign Application Priority Data

Aug. 6, 2002 (KR) ..... 10-2002-0046356

(51) Int. Cl.
*B41J 29/42* (2006.01)

(52) U.S. Cl. ..... 400/709; 400/708

(58) Field of Classification Search ..... 347/104, 347/105, 16, 101; 400/709, 708, 708.1, 705.3, 400/706

See application file for complete search history.

(56) References Cited

U.S. PATENT DOCUMENTS

| | | | | |
|---|---|---|---|---|
| 4,573,618 | A * | 3/1986 | Kikuchi | 226/42 |
| 4,741,526 | A * | 5/1988 | Reed | 271/261 |
| 4,759,205 | A * | 7/1988 | Kuwano et al. | 72/9.3 |
| 4,983,854 | A | 1/1991 | Mizuno et al. | 250/559.15 |
| 5,192,141 | A * | 3/1993 | Chung et al. | 400/56 |

(Continued)

FOREIGN PATENT DOCUMENTS

| | | | |
|---|---|---|---|
| CN | 2460300 | Y | 11/2001 |

(Continued)

OTHER PUBLICATIONS

European Patent Office Search Report issued Feb. 1, 2006.

*Primary Examiner*—Anthony H. Nguyen
(74) *Attorney, Agent, or Firm*—Staas & Halsey LLP

(57) ABSTRACT

A paper edge sensing apparatus for borderless printing comprises a first paper sensor mounted in connection with the carrier and the frame in the upstream of a paper convey direction of an ink jet position of the ink jet nozzles to detect sheet edges, and a controller controlling operations of the ink jet nozzles of the printer head according to a signal from the first paper sensor to control paper print margins. A paper edge sensing method comprises detecting a top edge of the sheet conveyed by the convey unit through the first paper sensor mounted to the carrier at an initial position, generating a top margin print command to jet ink with a predetermined top print margin through the ink jet nozzles of the printer head according to a top edge detection signal from the first paper sensor, detecting the bottom edge of the sheet through the first paper sensor as the carrier passes through the initial position, and generating a bottom margin print command to jet ink with a predetermined bottom print margin through the ink jet nozzles of the printer head according to a bottom edge detection signal of the first paper sensor. The paper edge sensing apparatus and method of borderless printing can improve a degree of precision in sensing paper edges such as top edge, bottom edge, left edge, right edge, and so on, in a borderless printing mode to reduce printing margins for the printer head to jet ink, to thereby reduce ink pollution and consumption due to unnecessary ink jetting.

18 Claims, 5 Drawing Sheets

U.S. PATENT DOCUMENTS 5,513,017 A * 4/1996 Knodt et al. ..... 358/471
5,678,159 A * 10/1997 Williams et al. ..... 399/395
5,725,211 A * 3/1998 Blanchard et al. ..... 271/265.02
6,305,856 B1 * 10/2001 Miyazaki ..... 400/279
6,435,641 B1 * 8/2002 Tung et al. ..... 347/16
6,467,900 B1 * 10/2002 Askren et al. ..... 347/104
6,496,211 B1 * 12/2002 Katsuma ..... 347/188
6,523,925 B1 * 2/2003 Driggers ..... 347/16

FOREIGN PATENT DOCUMENTS

| | | |
|---|---|---|
| EP | 0556045 | 8/1993 |
| EP | 1 184 189 A2 | 3/2002 |
| JP | 63112186 | 5/1988 |

* cited by examiner

PAPER EDGE SENSING APPARATUS AND METHOD FOR BORDERLESS PRINTING

CROSS-REFERENCE TO RELATED APPLICATIONS

This application claims the benefit of Korean Application No. 2002-46356, filed Aug. 6, 2002, in the Korean Intellectual Property Office, the disclosure of which is incorporated herein by reference.

BACKGROUND OF THE INVENTION

1. Field of the Invention

The present invention relates to an inkjet printer having a borderless printing function, and more particularly to a paper edge sensing apparatus and a method of borderless printing which can improve a degree of precision in sensing paper edges such as a top edge, a bottom edge, a left edge, a right edge, and so on, in a borderless printing mode to reduce printing margins for the printer head to jet ink, to thereby reduce ink pollution and consumption due to unnecessary ink jetting.

2. Description of the Related Art

In general, an inkjet printer 10 is, as shown in FIG. 1, provided with a paper supply tray or cassette 1 in which sheets of paper are loaded, a pickup roller 2 supplying, sheet by sheet, the sheets of paper P loaded in the paper supply cassette 1, a convey roller 3 and pressure roller 3*a* conveying a sheet picked up by the pickup roller 2, a sheet detector 7 disposed between the pickup roller 2 and the convey roller 3 and provided with a sensor actuator 9 and an optical sensor 8, a printer head 4 mounted to a carrier 14 to form an image on a sheet conveyed by the convey roller 3, and a paper discharge roller 5 and a star wheel 5*a* externally discharging a sheet on which an image is formed. The respective rollers 2, 3, and 5 are driven by a driving motor (not shown) through a gear train.

In the operations of the inkjet printer 10 structured as above, electric power is first applied to the driving motor to start the printer 10. Accordingly, a driving gear 6 rotates the pickup roller 2, convey roller 3, and paper discharge roller 5. At this time, the pickup roller 2 rotates in a direction to pick up a sheet of paper by a dynamic power switching gear unit (not shown), and the convey roller 3 and the paper discharge roller 5 rotate in a direction opposite to a direction in which the sheet is conveyed.

The pickup roller 2 cooperates with a friction buckler (not shown) supplying the sheets of paper P one by one to pick up and convey one of the sheets of paper P loaded in the paper supply cassette 1 by a certain distance toward the convey roller 3.

When the sensor actuator 9 of the sheet detector 7 moves by the upper end, that is, the leading end of a sheet of paper so that the optical sensor 8 generates an 'on' signal, the driving motor is driven to rotate the driving gear 6 in a reverse direction. As the driving gear 6 rotates in reverse, the dynamic power switching gear unit releases from the pickup roller 2 to stop the driving of the pickup roller 2, and, at the same time, rotates the convey roller 3 and the paper discharge roller 5 in a direction the sheet is conveyed so that the sheet enters a base frame 12.

When the inkjet printer 10 prints in a general print mode placing margins on the sheet, a controller (not shown) counts a period of time during which the optical sensor 8 generates an "on" signal. When a predetermined period of time lapses, that is, when the leading end of the sheet passes down an ink jet position below ink jet nozzles 4*a* and enters up to a predetermined print position, the controller generates a print command to jet ink through the ink jet nozzles 4*a* of the printer head 4.

When the ink jet printer 10 prints in a borderless print mode placing no margin on the sheet, the controller generates a print command when the leading end of the sheet arrives at a distance having a predetermined top margin T upstream in a sheet convey direction A from the ink jet position of the ink jet nozzles 4*a* as shown in a solid line of FIG. 2.

As above, when the print command is generated, the printer head 4 slides to the left and right by means of the carrier 14 supported by a carrier shaft 15 so as to jet ink on the sheet or the base frame 12, to thereby form images.

Thereafter, when the lower end, that is, the rear end of the sheet passes through the sensor actuator 9 and the optical sensor 8 generates an "off" signal, the controller generates a print end command to place a predetermined bottom margin in a general print mode before the rear end of the sheet reaches the ink jet position of the ink jet nozzles 4*a*, but, in the borderless print mode, the controller generates the print end command after the rear end of the sheet is further printed, as shown in dotted lines of FIG. 2, as much as a distance having a predetermined bottom margin B from the ink jet position of the ink jet nozzles 4*a*.

As above, the image-printed sheet is externally discharged from the printer by the paper discharge roller 5 and the star wheel 5*a*.

A conventional inkjet printer 10 estimates the distance between the ink jet position of the ink jet nozzles 4*a* and the leading and rear ends of the sheet, based on the operation timing of the sheet detector 7. In other words, since the distance between the position of an end of the paper when it is detected and the position of the ink jets are known, and since the speed of movement of the paper is also known, the location of the paper can be estimated.

However, the ink jet nozzles 4*a* and the sheet detector 7, which are supported by different frameworks, may cause many position detection errors due to manufacture or assembly errors, that is, of a difference between an estimated position of the paper based on a predetermined time period between when the sheet detector operates and the controller instructs a print command as compared to the actual position of the paper.

Such position detection errors are usually not a problem in the general print mode placing margins on a sheet, but lots of problems can occur in the borderless print mode when no margin is placed on the sheet since the accuracy of determining the position of the paper must be estimated within a narrower range.

That is, in the borderless print mode, the print area 20 is set, as shown in FIG. 3, to have predetermined print margins, that is, top, bottom, left, and right print margins T, B, L, and R outside boundaries of top, bottom, left, and right edges 15, 18, 16, and 17 of a sheet, if print tolerance errors occur.

Accordingly, in the borderless print mode, ink jetted on the top, bottom, left, and right print margins T, B, L, and R of the print area 20 by the ink jet nozzles 4*a* is jetted on a base frame 12, causing a problem of contaminating the bottom surface of a sheet passing over the base frame 12.

Further, such print margins are generally set in a range of 2~3 mm so that ink is unnecessarily jetted on the print margin area which increases a consumed amount of ink, to thereby increase the printer maintenance cost.

SUMMARY OF THE INVENTION

The present invention has been devised to solve the above and/or other problems, so an aspect of the present invention provides a paper edge sensing apparatus and a method of borderless printing, capable of improving a degree of precision in sensing paper edges such as a top edge, a bottom edge, a left edge, and a right edge in a borderless printing mode to reduce printing margins for the printer head to jet ink, to thereby reduce ink pollution and consumption due to unnecessary ink jetting.

According to an embodiment of the present invention to achieve the above, a paper edge sensing apparatus for borderless printing in an inkjet printer provided with a frame configured as a paper supply unit in which sheets of paper are loaded, a pickup unit picking up and supplying sheets loaded in the paper supply unit one by one, a convey unit conveying a sheet picked up from the pickup unit, and a printing unit constructed with a printer head having ink jet nozzles forming images on the sheet conveyed by the convey unit and a carrier in which the printer head is mounted, comprises a first paper sensor mounted in connection with the carrier and the frame in the upstream of a paper convey direction of an ink jet position of the ink jet nozzles to detect sheet edges, and a controller controlling operations of the ink jet nozzles of the printer head according to a signal from the first paper sensor to control paper print margins.

Implementations may include one or more of the following features. For example, in one implementation, the first paper sensor may include an optical sensor mounted in the carrier and provided with a light emitter emitting light and a light receiver receiving light, and a reflection surface on the frame to reflect light emitted from the light emitter to the light receiver. In a further implementation, the reflection surface is transversely arranged across a paper convey direction.

The print margins may include top, bottom, left, and right print margins spaced a predetermined distance from top, bottom, left, and right edges of a sheet of paper, respectively. In one implementation, the predetermined distance is set in a range of 0.5~1 mm.

The paper edge sensing apparatus of the present invention may further comprise a second paper sensor mounted between the pickup unit and the convey unit to detect top and bottom edges of a sheet.

The second paper sensor may include an optical sensor provided with a light emitter emitting light and a light receiver receiving light, and a sensor actuator rotatably mounted to the frame across the paper convey direction to operate the optical sensor.

According to a another embodiment of the present invention, a paper edge sensing method of borderless printing is performed in an inkjet printer provided with a frame configured as a paper supply unit in which sheets of paper are loaded, a pickup unit picking up and supplying sheets loaded in the paper supply unit one by one, a convey unit conveying a sheet picked up from the pickup unit, a printing unit constructed with a printer head having ink jet nozzles forming images on the sheet conveyed by the convey unit and a carrier in which the printer head is mounted, a first paper sensor mounted in connection with the carrier and the frame in the upstream of a paper convey direction of an ink jet position of the ink jet nozzles to detect sheet edges, and a controller controlling operations of the ink jet nozzles of the printer head according to a signal from the first paper sensor to control paper print margins. The paper edge sensing method of borderless printing comprises detecting a top edge of the sheet conveyed by the convey unit through the first paper sensor mounted to the carrier positioned at an initial position, generating a top margin print command to jet ink with a predetermined top print margin through the ink jet nozzles of the printer head according to a top edge detection signal from the first paper sensor, detecting left and right edges of the sheet through the first paper sensor as the carrier moves left and right by the top margin print command, generating a left and right margin print command to jet ink with left and right print margins according to a left and right edge detection signal from the first paper sensor, detecting the bottom edge of the sheet through the first paper sensor as the carrier passes through the initial position, and generating a bottom margin print command to jet ink with a predetermined bottom print margin through the ink jet nozzles of the printer head according to a bottom edge detection signal of the first paper sensor.

The above described method and apparatus may include one or more of the following features. For example, in an embodiment of the present invention, the top, bottom, left, and right print margins are each set to have a width of a range of 0.5~1 mm.

The paper edge sensing method may further comprise: detecting the top edge of the sheet through a second paper sensor disposed between the pickup unit and the convey unit to detect the top and bottom edges of the sheet, counting a period of time during which the top edge of the sheet moves to a desired position according to the top edge detection signal of the second paper sensor, comparing a timing of the period of time to move to the desired position and the position of the top edge of the sheet as detected by the first paper sensor, and generating the top margin print command based on a result of the comparison.

The operation of generating the top margin print command based on the comparison result may include setting a print start timing based on the timing occurring later out of the two timings.

Also, the paper edge sensing method may further comprise: detecting the bottom edge of the sheet through the second paper sensor disposed between the pickup unit and the convey unit to detect the top and bottom edges of the sheet, counting a period of time during which the sheet moves according to the bottom edge detection signal of the second paper sensor, comparing a timing at which the counted time lapses a predetermined second time with a timing at which the bottom edge of the sheet is detected through the first paper sensor, and generating the bottom margin print command based on a result of the comparison.

The operation generating the bottom margin print command based on the comparison result may be to set a print end time based on the time occurring later out of the two time measurements.

Additional aspects and advantages of the invention will be set forth in part in the description which follows and, in part, will be obvious from the description, or may be learned by practice of the invention.

BRIEF DESCRIPTION OF THE DRAWINGS

The above and/or other aspects and advantages of the present invention will become more apparent by describing, in detail, preferred embodiments thereof with reference to the attached drawings in which.

DETAILED DESCRIPTION OF THE PREFERRED EMBODIMENTS

Figure 1:
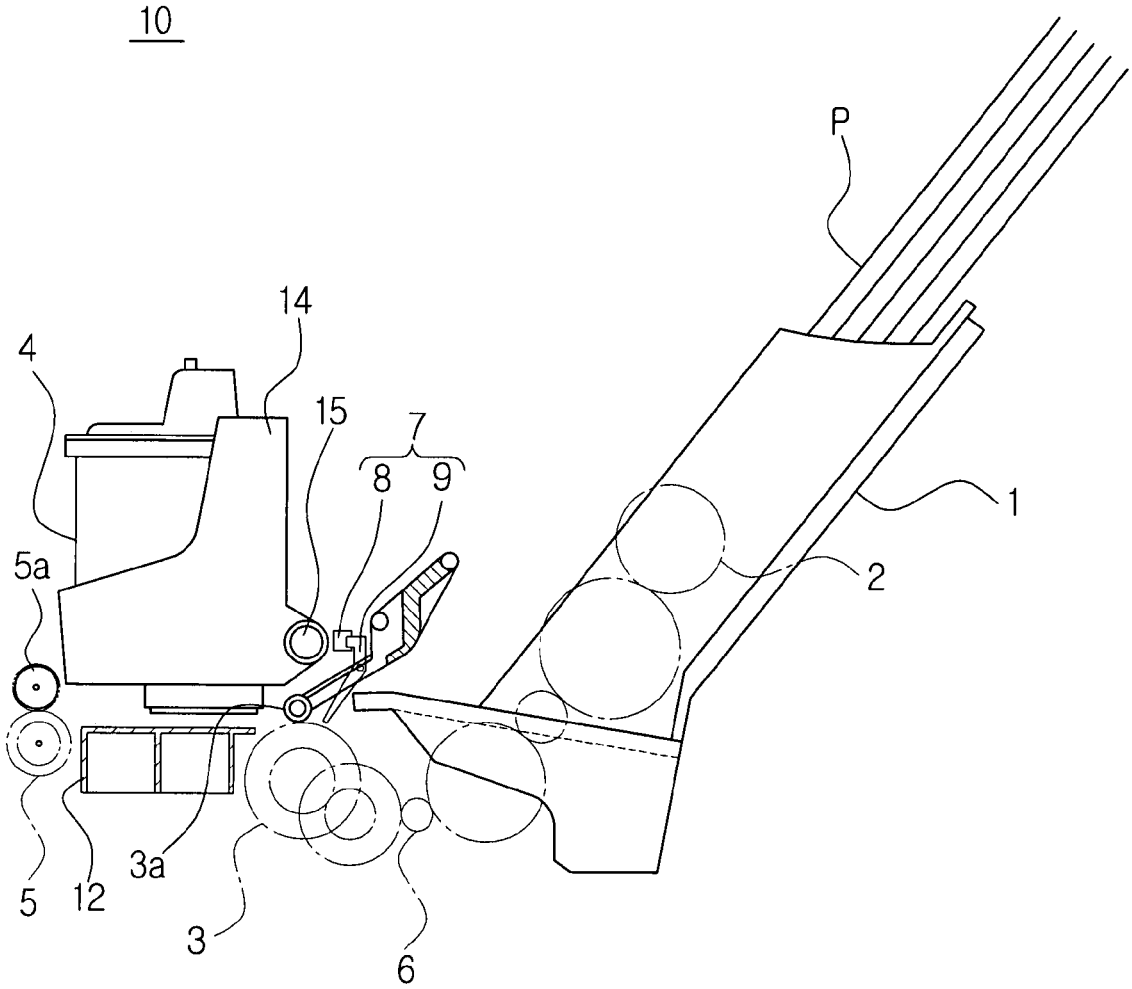
FIG. 1 (PRIOR ART)
FIG. 1 is a side view schematically showing a conventional inkjet printer having a sheet detector.
Figure 2:
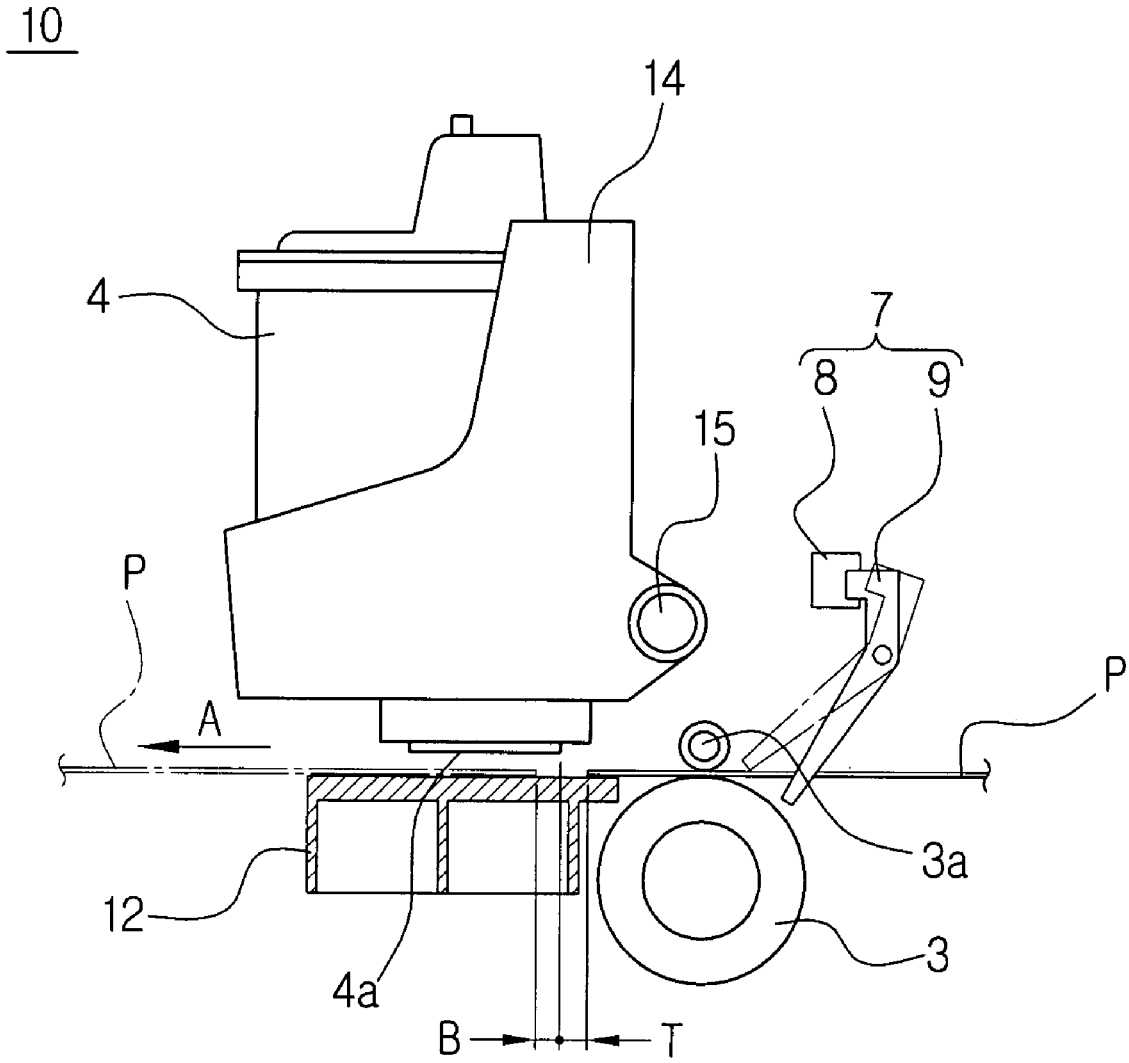
FIG.2 (PRIOR ART)
FIG. 2 is a view showing a partial inkjet printer of FIG. 1.

Hereinafter, descriptions are made in detail with reference to accompanying drawings on a paper edge sensing apparatus and a method of borderless printing according to embodiments of the present invention. Like reference numerals in the drawings and the specification refer to like elements throughout.

Figure 4:
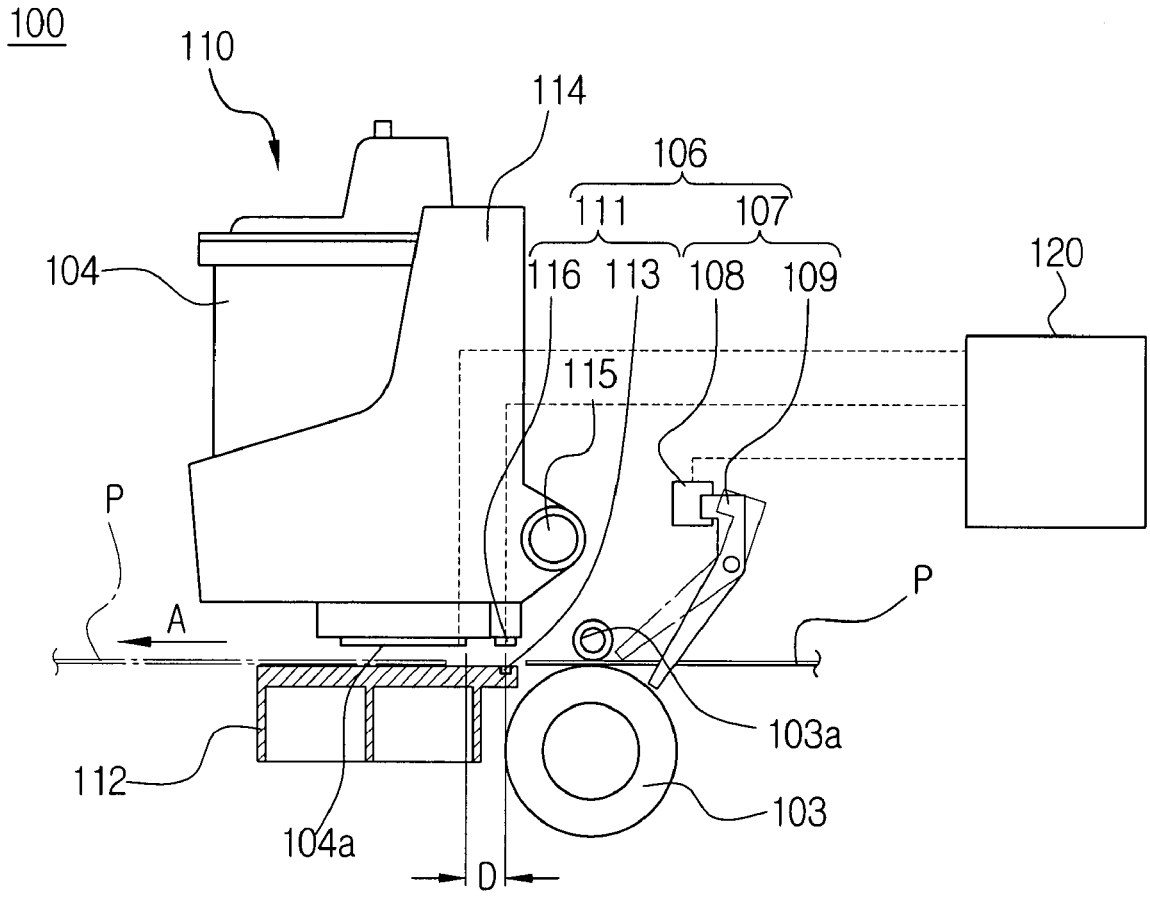
FIG. 4 is a view showing a partial inkjet printer to which a paper edge sensing apparatus for borderless printing according to an embodiment of the present invention is applied.

Referring to FIG. 4, an inkjet printer 100 having a paper edge sensing apparatus 106 for borderless printing according to an embodiment of the present invention is partially illustrated.

The inkjet printer 100 is provided with a base frame 112 configured as a paper supply unit (not shown) in which sheets of paper P are loaded, a pickup unit (not shown) picking up and supplying, sheet by sheet, paper P loaded in the paper supply unit, and a convey unit 103 and 103*a* conveying a sheet picked up by the pickup unit, and a print unit 110 provided with a printer head 104 having inkjet nozzles 104*a* forming images on the sheet conveyed by the convey unit 103 and 103*a* and a carrier 114 in which the printer head 104 is mounted.

The convey unit 103 and 103*a* is provided with a convey roller 103 conveying a sheet of paper picked up by the pickup unit, and a pressure roller 103*a* pressing the convey roller 103 with a predetermined pressure with respect to the sheet of paper P.

The carrier 114 is supported by a carrier shaft 115 to move left and right during printing.

The paper edge sensing apparatus 106 for borderless printing according to an embodiment of the present invention includes a first paper sensor 107 disposed between the pickup unit and the convey unit to detect the top and bottom edges 15 and 18 (see FIG. 3) of a sheet of paper, a second paper sensor 111 installed a predetermined distance D, for example, a distance of 0.5~1 mm, from an ink jet position with respect to the carrier 114 and the frame 115 upstream of the ink jet nozzles 104*a* relative to a paper convey direction A in order to detect paper edges 15, 18, 16, and 19, and a controller 120 controlling the operations of the inkjet nozzles 104*a* of the printer head 104 based on signals from the first and second paper sensors 107 and 111 in order to control the top, bottom, left, and right print margins T, B, L, and R of a sheet of paper.

The first paper sensor 107 is constructed with an optical sensor 108 having a light emitter emitting light and a light receiver receiving light, and a sensor actuator 109 rotatably mounted to the base frame 112 with an axis that is perpendicular to the paper convey direction A to operate the optical sensor 108.

The first paper sensor 107 detects the top and bottom edges 15 and 18 of a sheet of paper moving in the paper convey direction A and transmits the first top edge and bottom edge detection signals to the controller 120. The controller 120 controls the dynamic power switching from the pickup unit to the convey unit when the first top edge detection signal is generated, compares the first top edge and bottom edge detection signals with second top edge and bottom edge detection signals of the second paper sensor 111 which detects the top and bottom edges 15 and 18 to be later described, and controls the print start and end timing during which a sheet of paper is printed by the inkjet nozzles 104*a* of the printer head 104.

The second paper sensor 111 is constructed with an optical sensor 116 having a light emitter mounted in the carrier 114 to emit light and a light receiver receiving light, and a reflection surface 113 on the base frame 112 to reflect light emitted from the light emitter to the light receiver.

In one implementation, the reflection surface 113 is perpendicularly and longitudinally shaped with respect to the paper convey direction A.

The second paper sensor 111 detects the top and bottom edges 15 and 18 and the left and right edges 16 and 17 of the sheet and transmits the second top and bottom edge detection signals and the left and right edge detection signals to the controller 120.

The controller 120 identifies the signals transmitted from the second paper sensor 111 as detection signals with respect to the respective edges 15, 16, 17, and 18 relative to the positions of the carrier 114.

That is, if a detection signal is generated when the carrier 114 is located at an initial position in the central portion of the width of a sheet, the controller identifies the signal as a signal indicating the position of the top edge 15 or bottom edge 18 of a sheet, and, if a detection signal is generated when the carrier 114 is located outside the area of the left and right edges 16 and 17, the controller identifies the detection signal as indicating the position of the left edge 16 or right edge 17 of the sheet.

Further, the controller 120, as briefly referred to as above, compares the first and second top and bottom edge detection signals with respect to the top edge or bottom edge 15 or 18 of a sheet detected by the first and second sheet detection sensors 107 and 111, and decides the print start timing and the print end timing.

That is, the print start timing is determined as the later of the estimated timing of the top edge reaching a print position proximate to the ink jet nozzles 104*a* based on first edge detection signal and the speed of the paper moving through the printer and the timing at which the second top edge detection signal of the second paper sensor 111 occurs.

The print end timing is determined as the later of the estimated time that the bottom edge moves beyond the range of the upstream end of the ink jet nozzles based on the first edge detection signal and the speed of the paper and the timing at which the second bottom edge detection signal of the second paper detection sensor 111 with respect to the bottom edge 18 of a sheet occurs.

Figure 3:
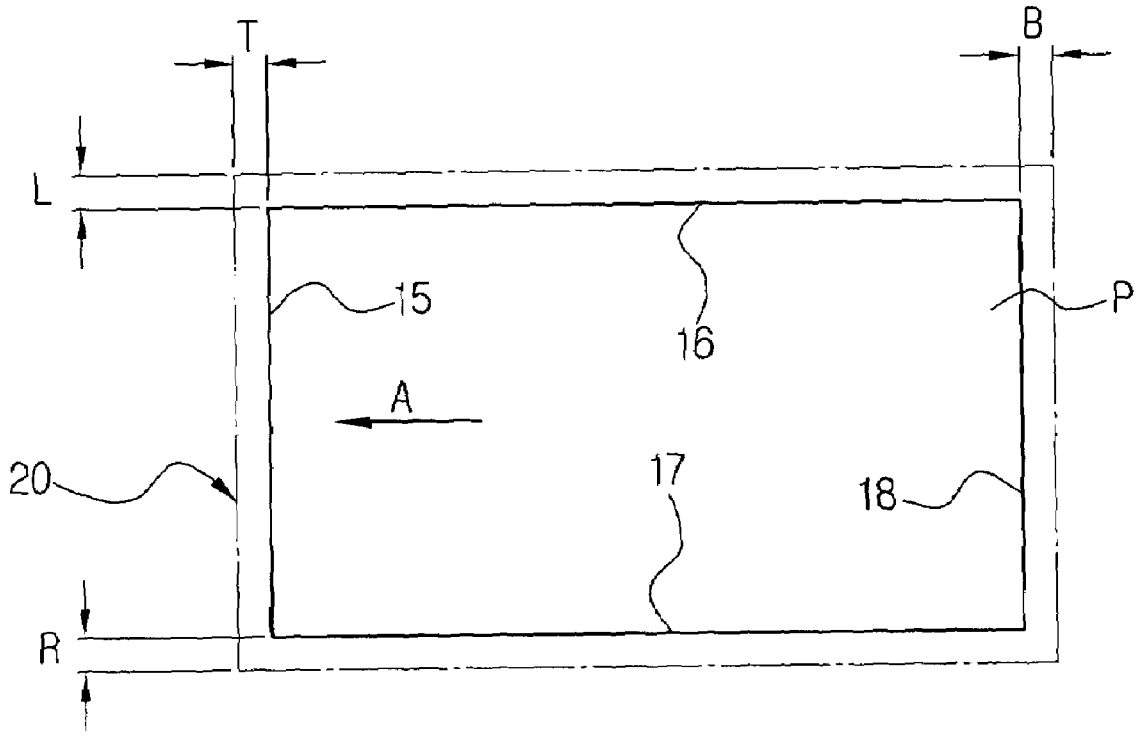
FIG. 3 is a plan view showing a sheet of paper on which a printing area for borderless printing is illustrated.

Accordingly, as shown in FIG. 3, in the borderless print mode, the width of the top and bottom print margins T and B additionally printed on the base frame 112 other than the surface of a sheet by the ink jet nozzles 104*a* of the printer head 104 can be maintained at least a distance D between an ink jet position of the ink jet nozzles 104*a* and the second paper sensor 111, that is, less than a range of 0.5~1 mm from the top and bottom edges 15 and 18 of the sheet.

The left and right print margins L and R are also set less than a range of 0.5~1 mm from the left and right edges 16 and 17.

In order to set the left and right print margins L and R, the left and right edges 16 and 17 of a sheet can be detected every time the carrier 114 moves outside transverse edges, but the widths of the left and right print margins L and R are the same in the longitudinal direction of the sheet, so the widths are only once detected just after the top edge 15 is detected, based on which of the left and right print margins L and R can be determined with respect to the entire sheet.

Figure 5:
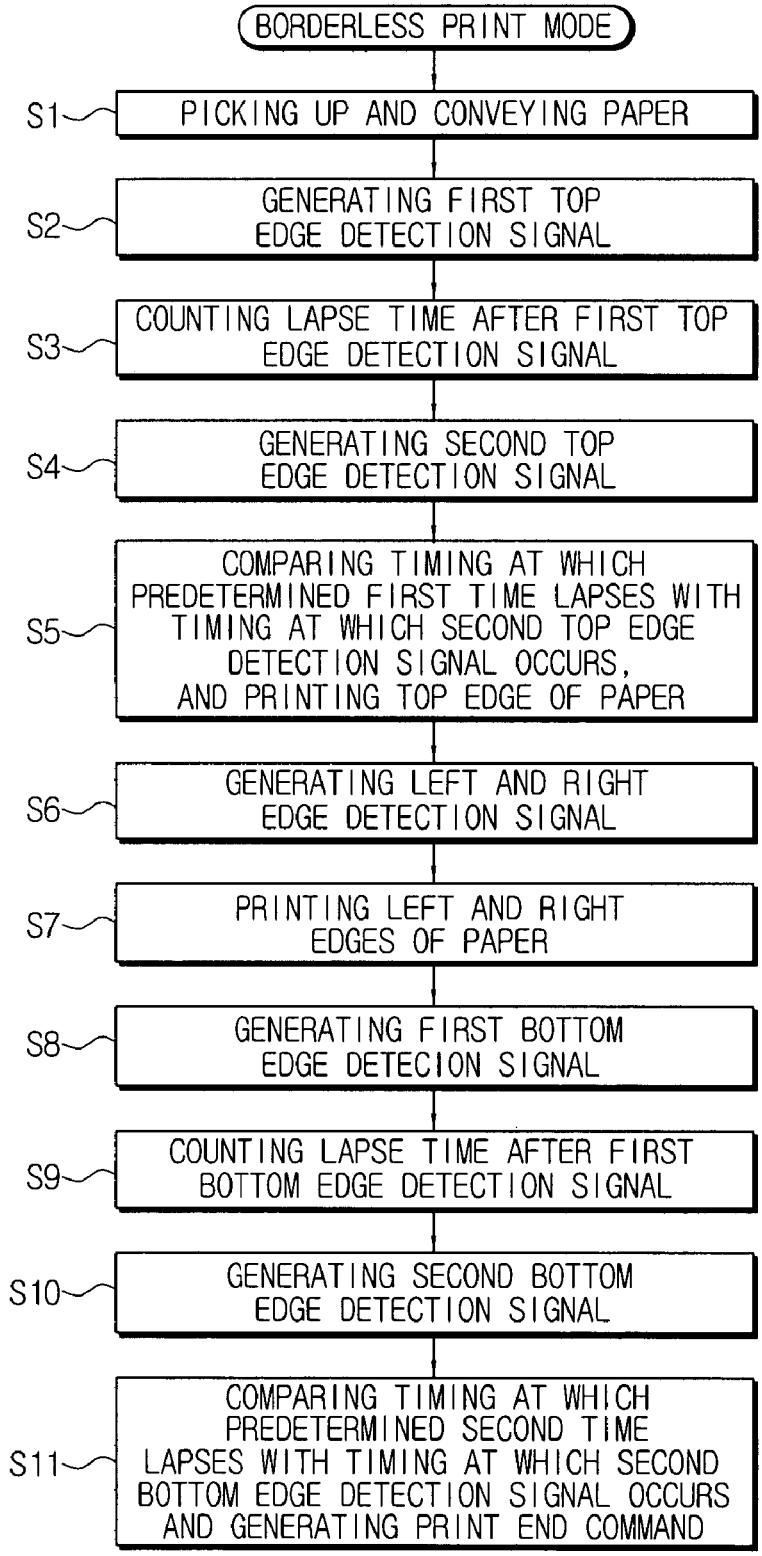
FIG. 5 is a flow chart explaining a borderless print mode of the inkjet printer shown in FIG. 4.

A paper edge sensing method using a paper edge sensing apparatus 106 for borderless printing according to the present invention as structured above will be described in detail below with reference to FIG. 4 and FIG. 5.

First, when a printer starts its operations, as in the inkjet printer 10 shown in FIG. 1, a sheet of paper is picked up by the pickup unit from the paper supply unit and then conveyed toward the first paper sensor 107 (S1).

Thereafter, when the sensor actuator 109 of the first paper sensor 107 is rotated (as shown in dotted lines of FIG. 4) by the top end, that is, the leading end of the sheet and then the optical sensor 108 generates a first top edge detection signal (S2), a driving motor rotates in a reverse direction and then the convey roller 103 is rotated in a sheet convey direction, so that the sheet is entered into the base frame 112.

At this time, the controller 120 starts counting a period of time after the optical sensor 108 generates the first top edge detection signal (S3).

Thereafter, when the leading end of the sheet reaches the second paper sensor 111 mounted upstream of the ink jet relative to the paper convey direction A, the second paper sensor 111 generates the second top edge detection signal (S4).

If the inkjet printer 100 performs a borderless print mode placing no margin on the sheet, the controller 120 estimates a period of time that the top edge 15 moves to a borderless print position by counting a time period beginning when the top edge 15 is detected by the first paper sensor and compares the estimated timing and the timing at which the second top edge detection signal occurs, and generates a print start command based on the timing occurring later.

Accordingly, the ink jet nozzles 104*a* of the printer head 104 jet ink at a position spaced by the top print margin T from the top edge 15 of the sheet moving left and right by the carrier 114 along the carrier shaft 115 based on the command of the controller 120 (S5).

However, when the inkjet printer 100 prints in a general print mode (not shown) placing margins on the sheet, the controller generates a print command after a period of time elapses during which the sheet moves by the margin width based on only the first or second top edge detection signal detected by the first or second paper sensor 107 or 111.

As above, as printing progresses while the carrier moves left and right, the second paper sensor 111 moves away from the left or right edge 16 or 17 of the sheet, and the optical sensor 116 of the second paper sensor 111 receives light from the reflection surface 113 again, so that the second paper sensor 111 generates a left or a right edge detection signal (S6).

When the second paper sensor 111 generates the left or the right edge detection signal, the controller 120 decides whether to be in the borderless print mode. When in the borderless print mode, the controller controls an extra ink jet as much as the predetermined left or the right print margin L or R from the left or the right edge 16 or 17 of the sheet (S7).

At this time, the controller 120 compares the width of the left or the right print margin L or R with data from an encoder detecting a movement amount of the carrier 114.

Thereafter, when the bottom end, that is, the rear end of the sheet passes through the sensor actuator 109 of the first paper sensor 107 and the sensor actuator 109 moves to its original position (solid lines of FIG. 4), the first paper sensor 107 generates a first bottom edge detection signal (S8).

At this time, the controller 120 starts counting an elapsed time after the optical sensor 108 generates the first bottom edge detection signal (S9) to estimate when the bottom edge of the paper is beyond a printable position.

Thereafter, when the rear end of the sheet passes through the reflection surface 113 of the second paper sensor 111 and the carrier 114 passes over the initial position again, the second paper sensor 111 generates a second bottom edge detection signal by the exposed reflection surface 113 (S10).

At this time, when the inkjet printer 100 performs the borderless print mode, the controller 120 compares the elapsed time obtained by counting a period of time after receiving the first bottom edge detection signal from the first paper sensor 107 during which the sheet moves to beyond a printable range to the timing at which the controller receives the second bottom edge detection signal. The controller generates the print end command based on the timing occurring later (S11).

However, when the inkjet printer 100 prints in the general print mode placing margins on the sheet, the controller 120 leaves a bottom margin on the sheet based on the first bottom edge detection signal of the first paper sensor 107 and generates the print end command.

As above, the image-printed sheet is externally discharged from the printer by the paper discharge roller (not shown) and the star wheel (not shown) of the paper discharge unit.

As described above, the paper edge sensing apparatus and method of borderless printing according to the present invention can improve a degree of precision in sensing paper edges such as the top edge, bottom edge, left edge, and right edge in a borderless printing mode to reduce printing margins for the printer head to jet ink, to thereby reduce ink pollution and consumption due to unnecessary ink jetting.

While the invention has been shown and described with reference to a particular embodiment thereof, it will be understood by those skilled in the art that various changes in form and details may be made therein without departing from the spirit and scope of the invention as defined by the appended claims.

What is claimed is:

1. A paper edge sensing apparatus in a printer having a pickup unit and a convey unit, the apparatus comprising:

a carrier;

a printer head mounted to the carrier;

a first paper sensor mounted between the pickup unit and the convey unit to detect a top edge and a bottom edge of a paper;

a second paper sensor mounted to the carrier a predetermined distance from the printer head, to detect a right edge, a left edge, the top edge, and the bottom edge of the paper; and a controller controlling operations of the printer head to control print margins of top and bottom ends of the paper by comparing first top edge and first bottom edge signals from the first paper sensor and second top edge and second bottom edge signals from the second paper sensor, and to control print margins of right and left edges of the paper according to left and right edge detections signals of the second paper sensor, wherein the controller determines a print start timing as a later of an estimated timing of the top edge reaching a print position proximate to the printer head based on the first top edge signal and a speed of the paper moving through the printer, or the second top edge signal.

2. The apparatus of claim 1, wherein the second paper sensor comprises:

an optical sensor mounted in the carrier and having a light emitter emitting light, a light receiver receiving light, and a reflection surface to reflect light emitted from the light emitter to the light receiver.

3. The apparatus of claim 2, wherein the reflection surface is transversely arranged across the paper convey direction.

4. The apparatus of claim 1, wherein:

the controller determines a print stop timing as a later of:

an estimated timing of the bottom edge moving beyond a range of an upstream end of the printer head based on the first bottom edge signal and a speed of the paper moving through the printer, or the second bottom edge signal.

5. The apparatus of claim 1, wherein the predetermined distance is in a range between 0.5 to 1 mm.

6. The apparatus of claim 1, wherein the controller controls the printer head to print within the print margin, to achieve a borderless image on the paper.

7. The apparatus of claim 1, wherein the first paper sensor comprises an optical sensor provided with a light emitter emitting light, a light receiver receiving light, and a sensor actuator rotatably mounted to the frame.

8. The apparatus of claim 1, further comprising:

an encoder detecting a movement amount of the carrier.

9. A paper edge sensing method in a printer having a first paper sensor disposed between a pickup unit and a convey unit, and a second paper sensor mounted in a fixed position relative to a moving printer head, comprising:

detecting a top edge and a bottom edge of a sheet of paper using the first paper sensor to output a corresponding first top edge detection signal and a first bottom edge detection signal;

beginning counting a start print time interval and an end print time interval upon detection, by the first paper sensor, of the top and the bottom edge, respectively;

detecting the top edge and the bottom edge of the paper using the second paper sensor to output a corresponding second top edge detection signal and a second bottom edge detection signal;

detecting a left edge or a right edge of the sheet of paper when the second paper sensor moves transversely to at least one of the left edge or the right edge of the sheet of paper; and generating a begin print command at a later of the start print time interval and the second top edge detection signal, and generating an end print command at a later of the end print time interval and the second bottom edge detection signal.

10. The method of claim 9, wherein the printer comprises a controller and the method further comprises:

transmitting the first and second top edge detection signals and the first and second bottom edge detection signals to the controller;

counting the start print time interval and the end print time interval using the controller;

comparing the start print time interval to the second top edge detection signal and the end print time interval to the second bottom edge detection signal using the controller; and controlling operation of the printer head based on a command from the controller.

11. The method of claim 9, wherein the printer comprises a pickup unit and a convey unit and further comprising:

controlling dynamic power switching from the pickup unit to the convey unit with the controller.

12. The method of claim 9, the printer comprising the second paper sensor and the printer head mounted to a movable carrier, and the method further comprising:

identifying a first detection signal as either of the first top edge detection signal or the first bottom edge detection signal if the first detection signal is generated when the carrier is located at an initial position in a central portion of a width of a sheet.

13. The method of claim 9, the printer comprising the second paper sensor and the printer head mounted to a movable carrier, and the method further comprising:

identifying a first detection signal as either a first right edge detection signal or a first left edge detection signal if the first detection signal is generated when the carrier is located outside of an initial position in a central portion of a width of the sheet.

14. The method of claim 9, the printer comprising a pickup unit and further comprising:

picking up the sheet to print thereon.

15. The method of claim 9, further comprising:

selecting a general print mode to place margins on the sheet.

16. The method of claim 9, further comprising:

selecting a borderless print mode such that no margins are placed on the sheet.

17. The method of claim 9, further comprising:

tracking a position of the second paper sensor.

18. The method of claim 9, further comprising:

externally discharging an image-printed sheet from the printer.

* * * * *